US009255671B2

(12) United States Patent
Needham

(10) Patent No.: US 9,255,671 B2
(45) Date of Patent: Feb. 9, 2016

(54) MULTI-WAVELENGTH-EMITTING LENS TO REDUCE BLENDING OF LIGHT OVER LONG DISTANCES

(71) Applicant: Nanoco Technologies, Ltd., Manchester (GB)

(72) Inventor: Dale Needham, Lancashire (GB)

(73) Assignee: Nanoco Technologies Ltd., Manchester (GB)

( * ) Notice: Subject to any disclaimer, the term of this patent is extended or adjusted under 35 U.S.C. 154(b) by 116 days.

(21) Appl. No.: 14/211,289

(22) Filed: Mar. 14, 2014

(65) Prior Publication Data

US 2014/0268639 A1 Sep. 18, 2014

Related U.S. Application Data

(60) Provisional application No. 61/788,131, filed on Mar. 15, 2013.

(51) Int. Cl.
*F21K 99/00* (2010.01)
*B61L 5/18* (2006.01)

(52) U.S. Cl.
CPC ..... *F21K 9/56* (2013.01); *B61L 5/1827* (2013.01); *B61L 2207/02* (2013.01)

(58) Field of Classification Search
CPC ..... F21K 9/56; B61L 5/1827; B61L 2207/00; B61L 2207/02
See application file for complete search history.

(56) References Cited

U.S. PATENT DOCUMENTS

| | | | | |
|---|---|---|---|---|
| 8,556,490 | B1 | 10/2013 | Bohler | |
| 2005/0062481 | A1 | 3/2005 | Vaughn et al. | |
| 2013/0271955 | A1* | 10/2013 | Van Bommel | B82Y 30/00 362/84 |
| 2014/0300267 | A1* | 10/2014 | Oh | H01L 33/60 313/46 |

FOREIGN PATENT DOCUMENTS

| | | | |
|---|---|---|---|
| EP | 1 259 412 | B1 | 4/2006 |
| EP | 2395569 | | 12/2011 |
| GB | 2472694 | A | 2/2011 |
| GB | 2514462 | A | 11/2014 |
| KR | 010324233 | | 11/2013 |

* cited by examiner

*Primary Examiner* — Robert May
(74) *Attorney, Agent, or Firm* — Blank Rome LLP

(57) ABSTRACT

A lamp for safety signalling is disclosed. The lamp uses quantum dot phosphors to down-convert light from a primary light source and provide red or green light.

7 Claims, 2 Drawing Sheets

MULTI-WAVELENGTH-EMITTING LENS TO REDUCE BLENDING OF LIGHT OVER LONG DISTANCES

FIELD OF THE INVENTION

Embodiments of the present invention relate to the design and function of lenses for use in various optical signalling applications, such as railway and airfield signal lights.

BACKGROUND

On railroad networks, such as the British Rail network, over-ground and underground signal heads are used to notify train drivers of whether a route is clear to continue their journey, or if a track is closed. Different colored signals, such as between two and four "aspects" (coloured light signals) can be used to convey different messages. As an example, red light (the stop aspect) signifies danger, telling the driver to stop, while green light informs a driver that a line is clear. Optionally, one or two yellow lights can also be used to caution drivers that they may need to stop at a signal further down the line.

Traditionally, coloured light signals have been produced using an incandescent white light source in combination with coloured lenses. The use of such a source has led to at least two problems. At long distances, light transmitted from red and green lenses can blend to give the appearance of white light. This is referred to as "colour blending" or "colour bleeding." Further, incandescent lamps typically have short lifetimes, requiring replacement every six to twelve months. Failure of the filament results in the lamp instantly turning off Though safety procedures are in place to avoid danger from signal failure, maintenance can cause major disruption to rail services such as diversions, delays and cancellations, often at short notice and with a high associated cost.

Lighting systems comprising light-emitting diodes (LEDs) emitting at multiple wavelengths have been introduced to overcome the problem of colour blending and the short lifespan of incandescent lamps for railway signaling applications. Using red and green LED signal heads, each comprising LEDs emitting across a wavelength gradient, colour blending can be alleviated. However, complex circuitry is required. Further, the cost associated with the manufacture and testing of these LED systems is high.

LEDs are traditionally made from inorganic semiconductors, which emit at a specific wavelength, e.g. AlGaInP (red), GaP (green), ZnSe (blue). Other forms of solid state LED lighting include organic light-emitting diodes (OLEDs), wherein the emissive layer is a conjugated organic molecule wherein delocalised $\pi$ electrons are able to conduct through the material, and polymer light emitting diodes (PLEDs), in which the organic molecule is a polymer. Advantages of LEDs over traditional incandescent lighting include superior longevity, lower energy consumption resulting from less energy loss as heat, superior robustness, durability and reliability, and faster switching times. This is advantageous for use in transport networks, where downtime associated with maintenance work can be costly. However, solid-state lighting (SSL) is expensive and it requires different materials to emit at different wavelengths. Further, long-red emission (beyond 660 nm) is difficult to achieve using LEDs. Consequently, signalling systems requiring a range of emission wavelengths to display one colour are unfavourable using LEDs.

Strategies to tune the emission of a single wavelength of LEDs include the use of phosphors. LEDs emitting in the UV or blue region of the electromagnetic (EM) spectrum, which are generally cheap and readily available, can be combined with one or more phosphorescent materials emitting at a longer wavelength. Examples of phosphors include SrSi:$Eu_2^+$ and $SrGaS_4$:$Eu_2^+$, which emit red and green light, respectively. However, the range of available phosphors limits the emission wavelengths that can be achieved using this method.

Quantum dot (QD) phosphors have been developed, which overcome some of the limitations of conventional phosphors. QDs, semiconductor nanoparticles of the order of 1-50 nm, can be tuned to emit at any wavelength from the UV to the near-IR region of the EM spectrum by controlling the particle size. Thus, simply manipulating the particle size during synthesis can control the colour of light emitted, even using a single type of QD material. Further, colloidally synthesized QDs are capped with organic ligands that impart solubility, making the materials solution processable. Combined with high fluorescence quantum yields, this means that tiny amounts of QD material are required to cover a large area.

In patent EP 1 259 412 B1 from Dialight Corporation, an LED lamp is proposed having one or more LEDs in a housing unit. By reverse mounting red and green LEDs, the circuitry can be arranged such that the application of a voltage of one polarity would result in emission from the red LEDs, while the application of the reverse polarity would result in green emission. While the lamp would result in superior longevity compared to incandescent lamps, requiring less frequent maintenance, and lower power consumption, the issue of colour blending is not address. Further, the circuitry required to produce multiple coloured emission would be more complex than that proposed in the present invention, where a single wavelength LED backlight can be used to produce both red and green (or indeed any other desired colour) emission.

Though LED-based signal heads do not fail as readily as incandescent lamps, one of their drawbacks is that current flow can continue even when an LED fails to emit. Further, failure of one LED typically increases the risk of concurrent failure of any other LEDs in the circuit. Consequently, systems to monitor and control the LED output have been developed. Patent application US 2005/0062481 A1 discloses an LED signal lamp with a data processor to monitor the output of each LED by matching its characteristics to a known diode curve. AlInGaP was proposed as a suitable yellow or red LED material, and InGaN as a green emitter. However, a problem with the system described in that application is that the green and the red/yellow emitting LEDs must be sorted (i.e., binned) to obtain lots that provide color consistency.

Patent GB 2472694 A from Unipart Rail Limited highlights the risks of using coloured LEDs, including inconsistent light output over the required operating temperature range for signal heads in the UK (−30 to 40° C.). Instead, it is proposed that more consistent light output can be achieved using white LEDs in combination with colour filters. Optionally, the colour filters may be shaped to act as lenses, and can be housed in a hooded signal unit to prevent undesired reflections known as "phantom signals". However, colour filters absorb wavelengths of light that are not emitted, therefore there is a large amount of energy wastage.

SUMMARY

A lighting system is disclosed uses single wavelength LED backlights with lenses embedded with QDs to down-convert the emission. Using a range of QDs of different particle size, multiple wavelengths can be emitted using a monochromatic backlight requiring simple circuitry, thus reducing the cost of manufacture and maintenance compared to solid state LED-based transportation signalling devices. Using the present lighting system, colour blending between red and green lenses can be prevented without using an array of LEDs emitting at multiple wavelengths that are costly and require complex circuitry.

The lighting system uses a UV or blue LED backlight, which are cheap and readily obtained, with a lens embedded with QD material to act as a down-converting phosphor. The lens design incorporates cylindrical wells in the back-face, into which QDs emitting at different wavelengths and/or intensities are deposited; this serves to out-couple the light reduce blending of light. The QD emission wavelength can be altered by changing the particle size, while varying the QD concentration can be used to control the relative emission intensities observed from the LED backlight and the QD phosphor.

The lens design can further incorporate a reflector, situated over the face of the LED backlight to in-couple the light directly into the QD lens; this serves to reduce the amount of internal reflection within the signal head, focussing the light into one direction. As a result, the required LED output intensity is reduced. Using QDs of differing wavelengths and narrow beam angles, the colours will have a reduced blending effect, i.e. they will not merge to appear white at long distances.

The emission intensity of such down-converted emission is typically much higher (typically as high as 80-90%, as determined by the photoluminescence quantum yield of the QDs) than with white LEDs using filters. Thus, the signal lights according to the instant disclosure are more energy efficient than those using filtered light. The emission wavelength of QDs is not significantly affected by small changes in temperature, so are relatively stable (within a few nanometers) within the required operating temperature range. Further, the UV or blue LED backlights proposed in the present invention are typically cheaper than white LED, reducing the maintenance cost of the signal head.

In comparison to incandescent lighting, the failure of QD phosphors with an LED backlight is gradual, rather than instant; this acts an indicator that the backlight and/or the QD-embedded lens need replacing, accommodating scheduled down-time. As a result, this can reduce the cost associated with paying maintenance staff to work unsociable hours to replace bulbs, along with reduced disruption to rail services.

Using QDs to tune the emission of the LED backlight, the construction cost of signal heads are reduced, since the cost of the UV or blue LED backlight and the QD material are significantly cheaper than producing a range of solid state LEDs emitting at each required wavelength. The QD emission wavelength can be tuned during synthesis by manipulating the nanoparticle size. Long-red emission (>660 nm), which is notoriously difficult to achieve using solid state LEDs, can be easily realised using QDs, which is advantageous to reduce colour blending between different coloured signals. Due to the employment of a monochromatic solid state LED backlight, the present lens design also requires less complex circuitry than signal head designs using multiple colours of LEDs as described in the prior art.

The optical design of the lens described herein results in an improved light distribution. Further, the energy consumption of the total lighting package could be reduced relative to existing commercially available rail signals, due to the reflector component. The lens design can be easily tailored to suit a variety of signal heads, e.g. with different distances between the centres of the green and the red lens. The lens design is suitable for use in conjunction with a light pipe, enabling light to be distributed to areas where insufficient space is available to accommodate the lens package.

Applications of the lighting system include, but are not restricted to, signal heads for the rail industry, and landing strips in the aeronautical industry, where existing issues include green lamps appearing blue over time, primarily due to demand and binning problems

DETAILED DESCRIPTION

Figure 1:
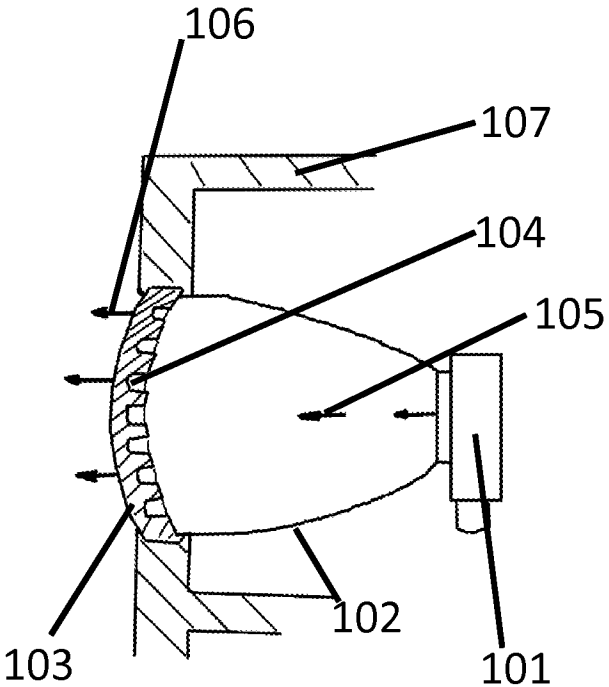
FIG. 1 is a diagram illustrating the rail lens design, comprising an LED backlight (blue in this example), with a reflector to focus the light in the direction of a lens containing a plurality of cylindrical wells. The wells are impregnated with red or green quantum dots (or other colours, as required), to down-convert the LED emission in order to emit red or green (or any other desired colour of) light.

An exemplary lamp with a lens architecture for a lighting system having single wavelength LED backlights with lenses embedded with QDs to down-convert the emission is illustrated in FIG. 1. The lens features a blue or UV LED 101 as a primary light source, mounted within a reflecting body 102. The lens also features a QD optic 103 with wells 104 for containing phosphors, such as red- or green-emitting quantum dots. The QD phosphors absorb blue or UV light 105 generated by primary light source 101 and emit red or green light 106, depending on whether a red or green-emitting QDs are used. The entire assembly can be contained within a housing 107.

Figure 2:
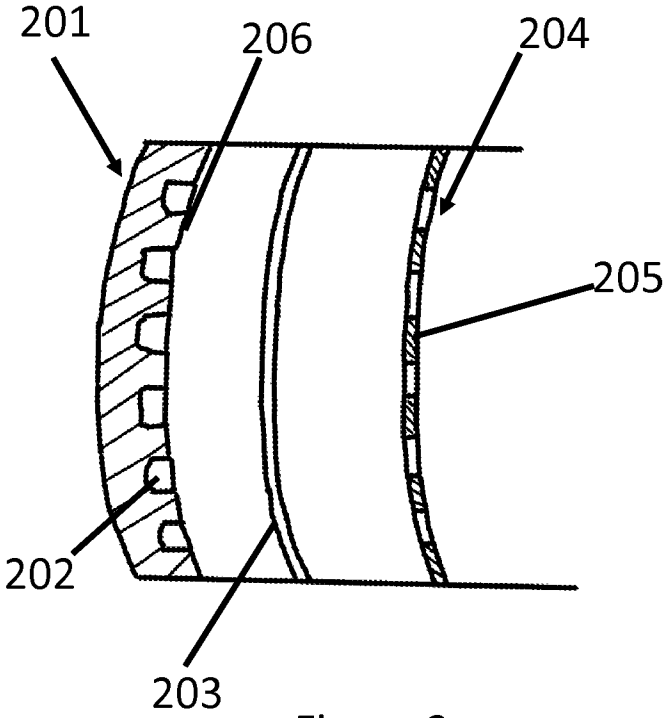
FIG. 2: Diagram illustrating a lens architecture, comprising a glass lens with cylindrical wells into which QD material is embedded, a transparent glass backing, and an aluminium backing to restrict the passage of light to the positions of the QD-embedded wells.

FIG. 2 illustrates an expanded view of an embodiment of the QD optic 103 illustrated in FIG. 1. The optic includes a shelled lens 201 incorporating a series of cylindrical wells 202 on one side, each of these wells being impregnated with QDs, a barrier 203, of a material such as a glass, with a sealed edge to protect the QDs from contaminants such as oxygen and moisture. The optic can also include a plate 204 having the same shape as the inner wall of lens 201. Plate 204 includes opaque sections 205 to prevent primary light from the primary light source from escaping trough the non-QD-impregnated regions 206 of lens 201.

In one embodiment, the wells within the lens are impregnated with a single type of QD material emitting at a single wavelength, e.g. 530 nm (green) or 640 nm (red). Colour blending is reduced by varying the concentration of the QDs within the wells, to alter the observed intensity of the red or green emission.

Figure 3:
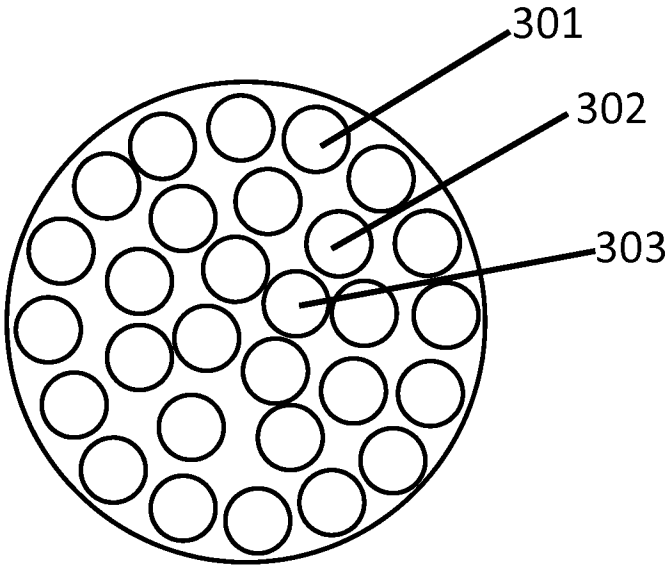
FIG. 3: Diagram showing the arrangement of QD-embedded wells in the lens, arranged with a colour gradient to reduce the effects of colour blending between red and green lenses at long distances. The colour gradient can be achieved using QDs emitting at different wavelengths, or by graduating the QD concentration.

In another embodiment, the wells within the lens are impregnated with one or more types of QD material emitting at multiple wavelengths within the same colour range of the EM spectrum e.g. 510-550 nm (green) or 620-660 nm (red) as shown in FIG. 3. It has been found that creating a colour gradient reduces the effects of colour blending between red and green signals. This can be achieved by filling the wells as concentric circles, each emitting at a slightly different wavelength from the adjacent circle(s). For example, for a green light, outer wells 301 may be filled with QDs emitting at wavelengths 540-550 nm, interior wells 302 may be filled with QDs emitting at wavelengths 530-540 nm, and center wells 303 may be filled with QDs emitting at wavelengths 520-530 nm.

To achieve the same results illustrated in FIG. 3 using LEDs without a QD- or similar phosphor (i.e., by using LEDs that themselves emit red or green), one would have to sort the LEDs into very narrow and specific wavelength bins and arrange LEDs of those bins in the desired pattern. This process is cumbersome and expensive. But the QD-containing optic of the instant disclosure, combined with a blue or UV emitting LED, can easily create such a colour gradient, simply by using QDs that emit at slightly different wavelengths (i.e., QDs that are slightly different in size).

The QD-containing material is embedded in a lens containing a series of wells. In addition to its lensing properties, the lens acts as a container to accommodate the QDs, and also as a barrier to protect the components of the lighting system from the surrounding environment. Thus, the lens must be constructed from a material that is resistant to a wide range of temperatures (e.g. −30 to 40° C. for use in the UK), pollutants, moisture, sunlight, and physical impact that may result from extreme weather conditions such as strong winds and hail storms. The lens can be constructed from any suitable optically transparent material including, but not restricted to, glass, polycarbonate, unplasticised polyvinyl chloride, etc.

Nanoparticles.

Suitable nanoparticles can include any QD materials emitting in the visible range, such as, but not restricted to II-IV compounds including a first element from group 12 (II) of the periodic table and a second element from group 16 (VI) of the periodic table, as well as ternary and quaternary materials including, but not restricted to: CdSe, CdTe, ZnS, ZnSe, ZnTe, ZnO, HgS, HgSe, HgTe, CdSeS, CdSeTe, CdSTe, ZnSeS, ZnSeTe, ZnSTe, HgSeS, HgSeTe, HgSTe, CdZnS, CdZnSe, CdZnTe, CdHgS, CdHgSe, CdHgTe, HgZnS, HgZnSe, HgZnTe, CdZnSeS, CdZnSeTe, CdHgSeS, CdHgSeTe, CdHgSTe, HgZnSeS, HgZnSeTe.

II-V compounds incorporating a first element from group 12 of the periodic table and a second element from group 15 of the periodic table, and also including ternary and quaternary materials and doped materials. Nanoparticle material includes, but is not restricted to: $Zn_3P_2$, $Zn_3As_2$, $Cd_3P_2$, $Cd_3AS_2$, $Cd_3N_2$, $Zn_3N_2$.

III-V compounds including a first element from group 13 (III) of the periodic table and a second element from group 15 (V) of the periodic table, as well as ternary and quaternary materials. Examples of nanoparticle materials include, but are not restricted to: BP, AlP, AlAs, AlSb, GaN, GaP, GaAs, GaSb, InN, InP, InAs, InSb, AlN, BN, GaNP, GaNAs, InNP, InNAs, GAInPAs, GaAlPAs, GaAlPSb, GaInNSb, InAlNSb, InAlPAs, InAlPSb.

III-VI compounds including a first element from group 13 of the periodic table and a second element from group 16 of the periodic table and also including ternary and quaternary materials. Nanoparticle material includes, but is not restricted to: $Al_2S_3$, $Al_2Se_3$, $Al_2Te_3$, $Ga_2S_3$, $Ga_2Se_3$, $In_2S_3$, $In_2Se_3$, $Ga_2Te_3$, $In_2Te_3$.

IV compounds including elements from group 14 (IV): Si, Ge, SiC, SiGe.

IV-VI compounds including a first element from group 14 (IV) of the periodic table and a second element from group 16 (VI) of the periodic table, as well as ternary and quaternary materials including, but not restricted to: PbS, PbSe, PbTe, SnSeS, SnSeTe, SnSTe, PbSeS, PbSeTe, PbSTe, SnPbSe, SnPbTe, SnPbSeTe, SnPbSTe.

Core QDs generally exhibit low photoluminescence quantum yields, therefore more preferably one or more shell layers of a wider band gap material should be grown epitaxially on the core surface to eliminate non-radiative recombination pathways, thus improving the optical properties of the material. The shell layer(s) grown on the nanoparticle core may include any one or more of the following materials:

IIA-VIB (2-16) material, incorporating a first element from group 2 of the periodic table and a second element from group 16 of the periodic table, and also including ternary and quaternary materials and doped materials. Nanoparticle material includes, but is not restricted to: MgS, MgSe, MgTe, CaS, CaSe, CaTe, SrS, SrSe, SrTe.

IIB-VIB (12-16) material incorporating a first element from group 12 of the periodic table and a second element from group 16 of the periodic table, and also including ternary and quaternary materials and doped materials. Nanoparticle material includes, but is not restricted to: ZnS, ZnSe, ZnTe, CdS, CdSe, CdTe, HgS, HgSe, HgTe.

II-V material incorporating a first element from group 12 of the periodic table and a second element from group 15 of the periodic table, and also including ternary and quaternary materials and doped materials. Nanoparticle material includes, but is not restricted to: $Zn_3P_2$, $Zn_3AS_2$, $Cd_3P_2$, $Cd_3AS_2$, $Cd_3N_2$, $Zn_3N_2$.

III-V material incorporating a first element from group 13 of the periodic table and a second element from group 15 of the periodic table, and also including ternary and quaternary materials and doped materials. Nanoparticle material includes, but is not restricted to: BP, AlP, AlAs, AlSb, GaN, GaP, GaAs, GaSb, InN, InP, InAs, InSb, AlN, BN.

III-IV material incorporating a first element from group 13 of the periodic table and a second element from group 14 of the periodic table, and also including ternary and quaternary materials and doped materials. Nanoparticle material includes, but is not restricted to: $B_4C$, $Al_4C_3$, $Ga_4C$.

III-VI material incorporating a first element from group 13 of the periodic table and a second element from group 16 of the periodic table, and also including ternary and quaternary materials. Nanoparticle material includes, but is not restricted to: $Al_2S_3$, $Al_2Se_3$, $Al_2Te_3$, $Ga_2S_3$, $Ga_2Se_3$, $In_2S_3$, $In_2Se_3$, $Ga_2Te_3$, $In_2Te_3$.

IV-VI material incorporating a first element from group 14 of the periodic table and a second element from group 16 of the periodic table, and also including ternary and quaternary materials and doped materials. Nanoparticle material includes, but is not restricted to: PbS, PbSe, PbTe, $Sb_2Te_3$, SnS, SnSe, SnTe.

Nanoparticle material incorporating a first element from any group in the d-block of the periodic table, and a second element from group 16 of the periodic table, and also including ternary and quaternary materials and doped materials. Nanoparticle material includes, but is not restricted to: NiS, CrS, $CuInS_2$, $CuInSe_2$, $CuGaS_2$, $CuGaSe_2$.

The use of heavy metals (cadmium, lead, and mercury) in lighting equipment is restricted in the EU under the Restriction of Hazardous Substances Directive (RoHS) 2011/65/EU. Similar legislation exists in the US and Asia. Therefore, the preferred method of the present invention uses heavy metal-free QDs, such as InP/ZnS core/shell nanoparticles.

Capping.

The coordination around the atoms on the surface of any core, core/shell or core/multishell nanoparticle is incomplete and the non-fully coordinated atoms have dangling bonds which make them highly reactive and can lead to particle agglomeration, which is undesirable for solution processing. This problem is overcome by passivating (capping) the "bare" surface atoms with protecting organic groups. The organic ligands can provide solubility, facilitating their processability.

The outermost layer (capping agent) of organic material or sheath material helps to inhibit particle-particle aggregation, further protecting the nanoparticles from their surrounding electronic and chemical environments. In many cases, the capping agent is the solvent in which the nanoparticle preparation is undertaken, and consists of a Lewis base compound, or a Lewis base compound diluted in an inert solvent such as a hydrocarbon. There is a lone pair of electrons on the Lewis base capping agent that is capable of a donor-type coordination to the surface of the nanoparticle, and includes mono- or multi-dentate ligands such as phosphines (trioctylphosphine, triphenylphosphine, t-butylphosphine, etc.), phosphine oxides (trioctylphosphine oxide, triphenylphosphine oxide, etc.), alkyl phosphonic acids, alkyl-amines (octadecylamine, hexadecylamine, octylamine, etc.), aryl-amines, pyridines, long chain fatty acids (myristic acid, oleic acid, undecylenic acid, etc.) and thiophenes, but is, as one skilled in the art will know, not restricted to these materials.

The outermost layer (capping agent) of a QD can also consist of a coordinated ligand with additional functional groups that can be used as chemical linkage to other inorganic, organic or biological material, whereby the functional group is pointing away from the QD surface and is available to bond/react/interact with other available molecules, such as amines, alcohols, carboxylic acids, esters, acid chlorides, anhydrides, ethers, alkyl halides, amides, alkenes, alkanes, alkynes, allenes, amino acids, azide groups, etc. but is, as one skilled in the art will know, not limited to these functionalised molecules. The outermost layer (capping agent) of a QD can also consist of a coordinated ligand with a functional group that is polymerisable and can be used to form a polymer layer around the particle.

The outermost layer (capping agent) can also consist of organic units that are directly bonded to the outermost inorganic layer such as via an S—S bond between the inorganic surface (ZnS) and a thiol capping molecule. These can also possess additional functional group(s), not bonded to the surface of the particle, which can be used to form a polymer around the particle, or for further reaction/interaction/chemical linkage.

Incorporation into Microbeads.

The QD-impregnated lens described herein can be fabricated with "bare" QDs embedded directly into the wells within the lens, or more preferably, they can be incorporated into microbeads prior to their embodiment into the lens wells; the QD microbeads exhibit superior robustness and longer lifetimes than bare QDs, and are more stable to the mechanical and thermal processing protocols of the signal head fabrication and assembly. By incorporating the QD material into polymer microbeads, the nanoparticles become more resistant to air, moisture and photo-oxidation, opening up the possibility for processing in air that would vastly reduce the manufacturing cost. The bead size can be tuned from 20 nm to 0.5 mm, enabling control over the ink viscosity without changing the inherent optical properties of the QDs. The viscosity dictates how the QD bead ink flows through a mesh, dries, and adheres to a substrate, so thinners are not required to alter the viscosity, reducing the cost of the ink formulation. By incorporating the QDs into microbeads, the detrimental effect of particle agglomeration on the optical performance of bare encapsulated QDs is eliminated.

One such method for incorporating QDs into microbeads involves growing the polymer bead around the QDs. A second method incorporates QDs into pre-existing microbeads.

With regard to the first option, by way of example, hexadecylamine-capped CdSe-based semiconductor nanoparticles can be treated with at least one, more preferably two or more polymerisable ligands (optionally one ligand in excess) resulting in the displacement of at least some of the hexadecylamine capping layer with the polymerisable ligand(s). The displacement of the capping layer with the polymerisable ligand(s) can be accomplished by selecting a polymerisable ligand or ligands with structures similar to that of trioctylphosphine oxide (TOPO), which is a ligand with a known and very high affinity for CdSe-based nanoparticles. It will be appreciated that this basic methodology may be applied to other nanoparticle/ligand pairs to achieve a similar effect. That is, for any particular type of nanoparticle (material and/or size), it is possible to select one or more appropriate polymerisable surface binding ligands by choosing polymerisable ligands comprising a structural motif which is analogous in some way (e.g. has a similar physical and/or chemical structure) to the structure of a known surface binding ligand. Once the nanoparticles have been surface-modified in this way, they can then be added to a monomer component of a number of microscale polymerisation reactions to form a variety of QD-containing resins and beads. Another option is the polymerisation of one or more polymerisable monomers from which the optically transparent medium is to be formed in the presence of at least a portion of the semiconductor nanoparticles to be incorporated into the optically transparent medium. The resulting materials incorporate the QDs covalently and appear highly coloured even after prolonged periods of Soxhlet extraction.

Examples of polymerisation methods that may be used to construct QD-containing beads include, but are not restricted to, suspension, dispersion, emulsion, living, anionic, cationic, RAFT, ATRP, bulk, ring-closing metathesis and ring-opening metathesis. Initiation of the polymerisation reaction may be induced by any suitable method that causes the monomers to react with one another, such as by the use of free radicals, light, ultrasound, cations, anions, or heat. A preferred method is suspension polymerisation, involving thermal curing of one or more polymerisable monomers from which the optically transparent medium is to be formed. Said polymerisable monomers preferably comprise methyl (meth) acrylate, ethylene glycol dimethacrylate and vinyl acetate. This combination of monomers has been shown to exhibit excellent compatibility with existing commercially available encapsulants and has been used to fabricate a light-emitting device exhibiting significantly improved performance compared to a device prepared using essentially prior art methodology. Other preferred polymerisable monomers are epoxy or polyepoxide monomers, which may be polymerised using any appropriate mechanism, such as curing with ultraviolet irradiation.

QD-containing microbeads can be produced by dispersing a known population of QDs within a polymer matrix, curing the polymer and then grinding the resulting cured material. This is particularly suitable for use with polymers that become relatively hard and brittle after curing, such as many common epoxy or polyepoxide polymers (e.g. Optocast™ 3553 from Electronic Materials, Inc., USA).

QD-containing beads may be generated simply by adding QDs to the mixture of reagents used to construct the beads. In some instances, nascent QDs will be used as isolated from the reaction employed for their synthesis, and are thus generally coated with an inert outer organic ligand layer. In an alternative procedure, a ligand exchange process may be carried out prior to the bead-forming reaction. Here, one or more chemically reactive ligands (for example a ligand for the QDs that also contains a polymerisable moiety) are added in excess to a solution of nascent QDs coated in an inert outer organic layer. After an appropriate incubation time the QDs are isolated, for example by precipitation and subsequent centrifugation, washed and then incorporated into the mixture of reagents used in the bead forming reaction/process.

These QD incorporation strategies will result in statistically random incorporation of the QDs into the beads and thus the polymerisation reaction will result in beads containing statistically similar amounts of the QDs. It will be obvious to one skilled in the art that bead size can be controlled by the choice of polymerisation reaction used in their construction, and additionally once a polymerisation method has been selected the bead size can also be controlled by selecting appropriate reaction conditions, e.g. by stirring the reaction mixture more quickly in a suspension polymerisation reaction to generate smaller beads. Moreover, the shape of the beads can be readily controlled by choice of procedure in conjunction with whether or not the reaction is carried out in a mould. The composition of the beads can be altered by changing the composition of the monomer mixture from which the beads are constructed. Similarly, the beads can also be cross-linked with varying amounts of one or more cross-linking agents (e.g. divinyl benzene). If beads are constructed with a high degree of cross-linking, e.g. greater than 5 mol % cross-linker, it may be desirable to incorporate a porogen (e.g. toluene or cyclohexane) during the bead-forming reaction. The use of a porogen in such a way leaves permanent pores within the matrix constituting each bead. These pores may be sufficiently large to allow the ingress of QDs into the bead.

QDs can also be incorporated in beads using reverse emulsion-based techniques. The QDs may be mixed with precursor(s) to the optically transparent coating material and then introduced into a stable reverse emulsion containing, for example, an organic solvent and a suitable salt. Following agitation, the precursors form microbeads encompassing the QDs, which can then be collected using any appropriate method, such as centrifugation. If desired, one or more additional surface layers or shells of the same or a different optically transparent material can be added prior to isolation of the QD-containing beads by addition of further quantities of the requisite shell layer precursor material(s).

In respect of the second option for incorporating QDs into beads, the QDs can be immobilised in polymer beads through physical entrapment. For example, a solution of QDs in a suitable solvent (e.g. an organic solvent) can be incubated with a sample of polymer beads. Removal of the solvent using any appropriate method results in the QDs becoming immobilised within the matrix of the polymer beads. The QDs remain immobilised in the beads unless the sample is resuspended in a solvent (e.g. organic solvent) in which the QDs are freely soluble. Optionally, at this stage the outside of the beads can be sealed. Alternatively, at least a portion of the QDs can be physically attached to prefabricated polymer beads. Said attachment may be achieved by immobilisation of the portion of the semiconductor nanoparticles within the polymer matrix of the prefabricated polymeric beads or by chemical, covalent, ionic, or physical connection between the portion of semiconductor nanoparticles and the prefabricated polymeric beads. Examples of prefabricated polymeric beads comprise polystyrene, polydivinyl benzene and a polythiol.

QDs can be irreversibly incorporated into prefabricated beads in a number of ways, e.g. chemical, covalent, ionic, physical (e.g. by entrapment) or any other form of interaction. If prefabricated beads are to be used for the incorporation of QDs, the solvent-accessible surfaces of the bead may be chemically inert (e.g. polystyrene) or alternatively they may be chemically reactive/functionalised (e.g. Merrifield's Resin). The chemical functionality may be introduced during the construction of the bead, for example by the incorporation of a chemically functionalised monomer, or alternatively chemical functionality may be introduced in a post-bead construction treatment, for example by conducting a chloromethylation reaction. Additionally, chemical functionality may be introduced by a post-bead construction polymeric graft or other similar process whereby chemically reactive polymer (s) are attached to the outer layers/accessible surfaces of the bead. More than one such post-construction derivation process may be carried out to introduce chemical functionality onto/into the bead.

As with QD incorporation into beads during the bead forming reaction, i.e. the first option described above, the prefabricated beads can be of any shape, size and composition, may have any degree of cross-linker and may contain permanent pores if constructed in the presence of a porogen. QDs may be imbibed into the beads by incubating a solution of QDs in an organic solvent and adding this solvent to the beads. The solvent must be capable of wetting the beads and, in the case of lightly cross-linked beads, preferably 0-10% cross-linked and most preferably 0-2% cross-linked, the solvent should cause the polymer matrix to swell in addition to solvating the QDs. Once the QD-containing solvent has been incubated with the beads, it is removed, for example by heating the mixture and causing the solvent to evaporate, and the QDs become embedded in the polymer matrix constituting the bead or alternatively by the addition of a second solvent in which the QDs are not readily soluble but which mixes with the first solvent causing the QDs to precipitate within the polymer matrix constituting the beads. Immobilisation may be reversible if the bead is not chemically reactive, or else if the bead is chemically reactive the QDs may be held permanently within the polymer matrix by chemical, covalent, ionic, or any other form of interaction.

Optically transparent media that are sol-gels and glasses, intended to incorporate QDs, may be formed in an analogous fashion to the method used to incorporate QDs into beads during the bead-forming process as described above. For example, a single type of QD (e.g. one emission wavelength) may be added to the reaction mixture used to produce the sol-gel or glass. Alternatively, two or more types of QD (e.g. two or more emission wavelengths) may be added to the reaction mixture used to produce the sol-gel or glass. The sol-gels and glasses produced by these procedures may have any shape, morphology or 3-dimensional structure. For example, the particles may be spherical, disc-like, rod-like, ovoid, cubic, rectangular, or any of many other possible configurations.

Once the QDs are incorporated into the beads, the formed QD-beads can be further coated with a suitable material to provide each bead with a protective barrier to prevent the passage or diffusion of potentially deleterious species, e.g. oxygen, moisture or free radicals from the external environment, through the bead material to the semiconductor nanoparticles. As a result, the semiconductor nanoparticles are less sensitive to their surrounding environment and the various processing conditions typically required to utilise the nanoparticles in applications such as the fabrication of QD-embedded lenses.

The coating is preferably a barrier to the passage of oxygen or any type of oxidising agent through the bead material. The coating may be a barrier to the passage of free radical species and/or is preferably a moisture barrier so that moisture in the environment surrounding the beads cannot contact the semiconductor nanoparticles incorporated within the beads.

The coating may provide a layer of material on a surface of the bead of any desirable thickness, provided it affords the required level of protection. The surface layer coating may be around 1 to 10 nm thick, up to around 400 to 500 nm thick, or more. Preferred layer thicknesses are in the range 1 nm to 200 nm, more preferably around 5 nm to 100 nm.

The coating can comprise an inorganic material, such as a dielectric (insulator), a metal oxide, a metal nitride or a silica-based material (e.g. a glass).

The metal oxide may be a single metal oxide (i.e. oxide ions combined with a single type of metal ion, e.g. $Al_2O_3$), or may be a mixed metal oxide (i.e. oxide ions combined with two or more types of metal ion, e.g. $SrTiO_3$). The metal ion(s) of the (mixed) metal oxide may be selected from any suitable group of the periodic table, such as group 2, 13, 14 or 15, or may be a transition metal, d-block metal, or lanthanide metal.

Preferred metal oxides are selected from the group consisting of $Al_2O_3$, $B_2O_3$, $CO_2O_3$, $Cr_2O_3$, CuO, $Fe_2O_3$, $Ga_2O_3$, $HfO_2$, $In_2O_3$, MgO, $Nb_2O_5$, NiO, $SiO_2$, $SnO_2$, $Ta_2O_5$, $TiO_2$, $ZrO_2$, $Sc_2O_3$, $Y_2O_3$, $GeO_2$, $La_2O_3$, $CeO_2$, $PrO_x$ (x=appropriate integer), $Nd_2O_3$, $Sm_2O_3$, $EuO_y$ (y=appropriate integer), $Gd_2O_3$, $Dy_2O_3$, $Ho_2O_3$, $Er_2O_3$, $Tm_2O_3$, $Yb_2O_3$, $Lu_2O_3$, $SrTiO_3$, $BaTiO_3$, $PbTiO_3$, $PbZrO_3$, $Bi_mTi_nO$ (m, n=appropriate integer), $Bi_aSi_bO$ (a, b=appropriate integer), $SrTa_2O_6$, $SrBi_2Ta_2O_9$, $YScO_3$, $LaAlO_3$, $NdAlO_3$, $GdScO_3$, $LaScO_3$, $LaLuO_3$, $Er_3Ga_5O_{13}$.

Preferred metal nitrides may be selected from the group consisting of BN, AlN, GaN, InN, $Zr_3N_4$, $Cu_2N$, $Hf_3N_4$, $SiN_e$ (c=appropriate integer), TiN, $Ta_3N_5$, Ti—Si—N, Ti—Al—N, TaN, NbN, MoN, $WN_d$ (d=appropriate integer), $WN_eC_f$ (e, f=appropriate integer).

The inorganic coating may comprise silica in any appropriate crystalline form. The coating may incorporate an inorganic material in combination with an organic or polymeric material, e.g. an inorganic/polymer hybrid, such as a silica-acrylate hybrid material. The coating can comprise a polymeric material which may be a saturated or unsaturated hydrocarbon polymer, or may incorporate one or more heteroatoms (e.g. O, S, N, halo) or heteroatom-containing functional groups (e.g. carbonyl, cyano, ether, epoxide, amide, etc.).

Examples of preferred polymeric coating materials include acrylate polymers (e.g. polymethyl(meth)acrylate, polybutylmethacrylate, polyoctylmethacrylate, alkylcyanoacryaltes, polyethyleneglycol dimethacrylate, polyvinylacetate, etc.), epoxides (e.g. EPOTEK 301 A and B Thermal curing epoxy, EPOTEK OG112-4 single-pot UV curing epoxy, or EX0135 A and B Thermal curing epoxy), polyamides, polyimides, polyesters, polycarbonates, polythioethers, polyacrylonitryls, polydienes, polystyrene polybutadiene copolymers (Kratons), pyrelenes, poly-para-xylylene (parylenes), polyetheretherketone (PEEK), polyvinylidene fluoride (PVDF), polydivinyl benzene, polyethylene, polypropylene, polyethylene terephthalate (PET), polyisobutylene (butyl rubber), polyisoprene, and cellulose derivatives (methyl cellulose, ethyl cellulose, hydroxypropylmethyl cellulose, hydroxypropylmethylcellulose phthalate, nitrocellulose), and combinations thereof.

Stability Enhancement.

By incorporating QDs into beads in the presence of materials that act as stability-enhancing additives, and optionally providing the beads with a protective surface coating, migration of deleterious species, such as moisture, oxygen and/or free radicals, is eliminated or at least reduced, with the result of enhancing the physical, chemical and/or photo-stability of the semiconductor nanoparticles.

An additive may be combined with "bare" semiconductor nanoparticles and precursors at the initial stages of the production process of the beads. Alternatively, or additionally, an additive may be added after the semiconductor nanoparticles have been entrapped within the beads.

The additives that may be added singly or in any desirable combination during the bead formation process can be grouped according to their intended function, as follows:

a. mechanical sealing: fumed silica (e.g. Cab-O-Sil™), ZnO, $TiO_2$, ZrO, Mg stearate, Zn Stearate, all used as a filler to provide mechanical sealing and/or reduce porosity.
b. Capping agents: tetradecyl phosphonic acid (TDPA), oleic acid, stearic acid, polyunsaturated fatty acids, sorbic acid, Zn methacrylate, Mg stearate, Zn stearate, isopropyl myristate. Some of these have multiple functionalities and can act as capping agents, free radical scavengers and/or reducing agents.
c. Reducing agents: ascorbic acid palmitate, alpha tocopherol (vitamin E), octane thiol, butylated hydroxyanisole (BHA), butylated hydroxytoluene (BHT), gallate esters (propyl, lauryl, octyl, etc.), a metabisulfite (e.g. the sodium or potassium salt).
d. Free radical scavengers: benzophenones.
e. Hydride reactive agents: 1,4-butandiol, 2-hydroxyethyl methacrylate, allyl methacrylate, 1,6-heptadiene-4-ol, 1,7-octadiene, and 1,4-butadiene.

The selection of the additive(s) for a particular application will depend upon the nature of the semiconductor nanoparticle material (e.g. how sensitive the nanoparticle material is to physical, chemical and/or photo-induced degradation), the nature of the primary matrix material (e.g. how porous it is to potentially deleterious species, such as free-radicals, oxygen, moisture, etc.), the intended function of the final material or device which will contain the primary particles (e.g. the operating conditions of the material or device), and the process conditions required to fabricate the said final material or device. With this in mind, one or more appropriate additives can be selected from the above five lists to suit any desirable semiconductor nanoparticle application.

EXAMPLES

The wells within the lens can be embedded with QD material according to the following procedures:

Example 1

In one embodiment of the current invention, the wells in the lens are filled with organic-capped QDs mixed in an acrylate resin. In a nitrogen-filled glove box, the lens wells are first covered with a blank silicone resin to protect the lens from any damage from the acrylate resin in which the QDs are embedded. The silicone resin is cured on a hotplate. The lens wells are then filled with the QD-embedded acrylate resin, which is cured under UV light. The lens is then encapsulated using a thin gas-barrier layer, attached using a UV curing epoxy resin (e.g. Optocast™), and cured under UV light.

Example 2

In another embodiment of the present invention, the wells in the lens are filled with QD beads. Silicone resin is mixed with a small amount of a Pt catalyst, then the QD beads are added and the mixture is transferred to the wells in the lens.

The lens is cured under a nitrogen atmosphere, then encapsulated under a thin layer of gas-barrier, attached to a UV curing epoxy resin. The lens is then cured under UV light.

The invention has been described herein with reference to representative and non-limiting embodiments. Numerous modifications and adaptions are possible without deviating from the scope of the invention.

I claim:

1. A lamp, comprising:

a primary light source; and an optical element comprising:

a lens comprising a patterned plurality of cylindrical wells, each well containing quantum dots (QDs), and a seal forming an airtight seal of the QDs within the wells, wherein the patterned plurality of cylindrical wells comprise concentric circles and wherein QDs contained within wells of a first subset of the concentric circles emit light having a different wavelength than light emitted by QDs contained within a second subset of the concentric circles.

2. The lamp of claim 1, wherein all of the QDs emit light in the red portion of the visible spectrum and wherein the QDs contained within wells of the first subset of the concentric circles emit light having a different wavelength in the red portion of the visible spectrum than the light emitted by the QDs contained within the second subset of the concentric circles.

3. The lamp of claim 1, wherein all of the QDs emit light in the green portion of the visible spectrum and wherein the QDs contained within wells of the first subset of the concentric circles emit light having a different wavelength in the green portion of the visible spectrum than the light emitted by the QDs contained within the second subset of the concentric circles.

4. The lamp of claim 1, wherein the primary light source is a blue-emitting or a UV-emitting LED.

5. The lamp of claim 1, wherein the QDs are contained within a polymer.

6. The lamp of claim 1, wherein the QDs are contained within polymer beads.

7. An optical element comprising:

a lens comprising a patterned plurality of cylindrical wells, each well containing quantum dots (QDs), and a seal forming an airtight seal of the QDs within the wells, wherein the patterned plurality of cylindrical wells comprise concentric circles and wherein QDs contained within wells of a first subset of the concentric circles emit light having a different wavelength than light emitted by QDs contained within a second subset of the concentric circles.

* * * * *